US011531295B1

(12) United States Patent
Yoshikawa et al.

(10) Patent No.: US 11,531,295 B1
(45) Date of Patent: Dec. 20, 2022

(54) FIXING BELT, FIXING DEVICE, AND IMAGE FORMING APPARATUS

(71) Applicant: FUJIFILM Business Innovation Corp., Tokyo (JP)

(72) Inventors: Ryohei Yoshikawa, Kanagawa (JP); Tomotake Inagaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/493,807

(22) Filed: Oct. 4, 2021

(30) Foreign Application Priority Data

May 26, 2021 (JP) ..... JP2021-088681

(51) Int. Cl.
*G03G 15/20* (2006.01)
*G03G 15/16* (2006.01)

(52) U.S. Cl.
CPC ..... *G03G 15/2057* (2013.01); *G03G 15/161* (2013.01); *G03G 15/2064* (2013.01)

(58) Field of Classification Search
CPC ..... G03G 15/2017; G03G 15/2053; G03G 15/2057; G03G 2215/2003; G03G 2215/2016
See application file for complete search history.

(56) References Cited

U.S. PATENT DOCUMENTS 8,445,090 B2 5/2013 Nakajima et al.
2014/0255067 A1* 9/2014 Matsunaka ..... G03G 15/2057 399/333
2019/0377290 A1* 12/2019 Kitano ..... G03G 15/2057

FOREIGN PATENT DOCUMENTS

JP 2011186127 9/2011
JP 2019140105 8/2019

* cited by examiner

*Primary Examiner* — Thomas S Giampaolo, II
(74) *Attorney, Agent, or Firm* — JCIPRNET

(57) ABSTRACT

A fixing belt includes, in the following order: a resin base material layer; an elastic layer; and a release layer, in which the elastic layer contains an elastic material and an aggregate in which plural fibrous carbons are entangled with each other, and a maximum diameter of the aggregate is 15% or less of a film thickness of the elastic layer.

19 Claims, 5 Drawing Sheets

FIXING BELT, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-088681 filed May 26, 2021.

BACKGROUND

(i) Technical Field

The present invention relates to a fixing belt, a fixing device, and an image forming apparatus.

(ii) Related Art

For example, in an image forming apparatus using an electrophotographic method (such as a copier, a facsimile, and a printer), a fixing belt that fixes a toner image formed on a recording medium to the recording medium is used.

JP2019-140105A discloses a functional film containing an aggregate consisting of entangled carbon nanotubes and having a diameter of 50 μm or less, a height of less than 5 μm, and a ratio (height/diameter) of the height to the diameter of less than 0.1.

Further, JP2011-186127A discloses a polyimide tube in which carbon nanotubes are dispersed in a polyimide resin, as a needle-like high thermal conductive filler.

SUMMARY

Aspects of non-limiting embodiments of the present disclosure relate to a fixing belt that may suppress offset even in a case of using a recording medium with large surface unevenness, as compared with a case where an elastic layer contains only fibrous carbons that are not entangled with each other, as a fibrous carbon, or a case where a belt contains an aggregate in which a plurality of fibrous carbons are entangled with each other, and where a maximum diameter of the aggregate is more than 15% of a belt film thickness.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

As specific means, the following aspects are contained. According to an aspect of the present disclosure, there is provided a fixing belt includes, in the following order: a resin base material layer; an elastic layer; and a release layer, in which the elastic layer contains an elastic material and an aggregate in which a plurality of fibrous carbons are entangled with each other, and a maximum diameter of the aggregate is 15% or less of a film thickness of the elastic layer.

BRIEF DESCRIPTION OF THE DRAWINGS

Exemplary embodiment(s) of the present invention will be described in detail based on the following figures, wherein.

DETAILED DESCRIPTION

Figure 1:
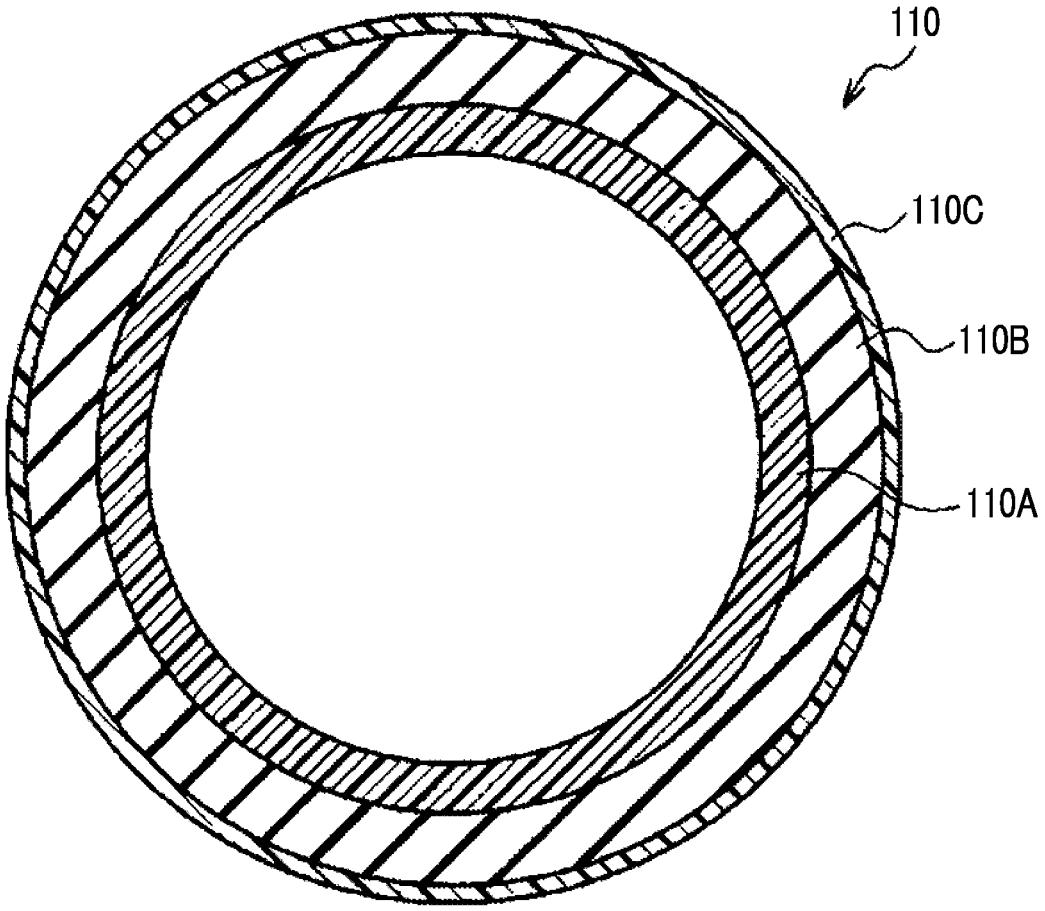
FIG. 1 is a schematic cross sectional diagram showing an example of a fixing belt according to the present disclosure.

Hereinafter, exemplary embodiments of the present disclosure will be described. These descriptions and examples illustrate the exemplary embodiments and do not limit the scope of the exemplary embodiments.

In a numerical range described stepwise in the present specification, an upper limit value or a lower limit value described in one numerical range may be replaced with an upper limit value or a lower limit value of another numerical range described stepwise.

Further, in a numerical range described in the present specification, an upper limit value or a lower limit value of the numerical range may be replaced with a value shown in examples.

In the present specification, each component may contain plural kinds of substances corresponding thereto.

In a case where the amount of each component in a composition is mentioned in the present specification and plural kinds of substances corresponding to each component are present in the composition, unless otherwise specified, the amount means a total amount of the plural kinds of substances present in the composition.

In the present specification, unless otherwise specified, a case where simply the term "fixing belt according to the present disclosure" is used refers to a belt described in both a first exemplary embodiment and a second exemplary embodiment, which will be described later.

Fixing Belt

The first exemplary embodiment of a fixing belt according to the present disclosure includes, in the following order: a resin base material layer; an elastic layer; and a release layer, in which the elastic layer contains an elastic material and an aggregate in which a plurality of fibrous carbons are entangled with each other, and a maximum diameter of the aggregate is 15% or less of a film thickness of the elastic layer.

A second exemplary embodiment of the fixing belt according to the present disclosure includes, in the following order: a resin base material layer; an elastic layer; and a release layer, in which the elastic layer contains an elastic material and a fibrous carbon, has a thermal conductivity of 1.0 W/m·K or more and 4.5 W/m·K or less, and has a Young's modulus of 0.2 MPa or more and 1.0 MPa or less.

Hereinafter, the aggregate in which plural fibrous carbons are entangled with each other is appropriately referred to as a specific aggregate.

In the fixing belt, the elastic layer is a layer provided in the viewpoint of imparting elasticity to a pressure applied to the fixing belt from an outer peripheral side, and plays a role of bringing the surface of the fixing belt into close contact with the toner image by following surface unevenness of a recording medium and unevenness of a toner image on the recording medium.

The elastic layer contains a thermal conductive substance from the viewpoint of increasing a fixability, but hardness of the elastic layer increases as the content of the thermal conductive substance increases. In a case where the hardness of the elastic layer increases, a shape followability to the surface unevenness or the like of the recording medium is lowered. In particular, an offset may occur in a case where a recording medium having a large surface unevenness is used. Here, the "offset" refers to a phenomenon in which a part of the toner image adheres to the fixing belt in a case where the toner image is fixed on the recording medium. In a case where the phenomenon occurs, an image defect occurs in the fixed image.

In the first exemplary embodiment of the fixing belt according to the present disclosure, the elastic layer includes, together with an elastic material, the aggregate (that is, the specific aggregate) in which plural fibrous carbons are entangled with each other. Since this specific aggregate transfers heat radially from the portion where the fibrous carbons are entangled, higher thermal conductivity is imparted to the elastic layer as compared with a case of containing the fibrous carbons that are not entangled with each other. As a result, it is considered that in a case where a specific aggregate is used, the amount of the thermal conductive material in the elastic layer is reduced, and sufficient thermal conductivity may be obtained without increasing the hardness of the elastic layer too much. Therefore, it is presumed that in the first exemplary embodiment of the fixing belt according to the present disclosure, the above configuration makes possible to obtain an elastic layer having sufficient thermal conductivity and excellent shape followability to the surface unevenness or the like of the recording medium and the offset may be suppressed even in a case of using a recording medium having a large surface unevenness.

Further, the second exemplary embodiment of the fixing belt according to the present disclosure has an elastic layer exhibiting the thermal conductivity as described above and Young's modulus. It is presumed that the fixing belt having the elastic layer (that is, the second exemplary embodiment of the fixing belt according to the present disclosure) has sufficient thermal conductivity and excellent shape followability to the surface unevenness or the like of the recording medium, and thus the offset may be suppressed even in a case of using the recording medium having a large surface unevenness.

The fixing belt according to the present disclosure will be described with reference to FIG. 1.

FIG. 1 is a schematic cross sectional diagram showing an example of the fixing belt according to the present disclosure.

A fixing belt 110 shown in FIG. 1 includes a resin base material layer 110A, an elastic layer 110B provided on the resin base material layer 110A, and a release layer 110C provided on the elastic layer 110B.

A layer structure of the fixing belt 110 according to the present disclosure is not limited to the layer structure shown in FIG. 1, and may also be a layer structure in which a metal layer and a protective layer therefor are interposed between the base material layer 110A and the elastic layer 110B, a layer structure in which an adhesive layer is interposed between the base material layer 110A and the elastic layer 110B, a layer structure in which an adhesive layer is interposed between the elastic layer 110B and the release layer 110C, and a layer structure combining these layer structures.

Hereinafter, components of the fixing belt according to the present disclosure will be described in detail. The description will be made without reference numerals.

First, an elastic layer (hereinafter, also referred to as an elastic layer (1)) in the first exemplary embodiment of the fixing belt according to the present disclosure and an elastic layer (hereinafter, so referred to as an elastic layer (2)) in the second exemplary embodiment of the fixing belt according to the present disclosure will be described.

Elastic Layer (1)

In the first exemplary embodiment of the fixing belt according to the present disclosure, the elastic layer (that is, the elastic layer (1)) includes an elastic material and an aggregate (that is, the specific aggregate) in which plural fibrous carbons are entangled with each other.

The maximum diameter of the aggregate is 15% or less of a film thickness of the elastic layer.

Specific Aggregate

The specific aggregate in the elastic layer (1) is used as a thermal conductive material.

As described above, the maximum diameter of the specific aggregate may be 15% or less of the film thickness of the elastic layer, and is, for example, more preferably 10% or less of the film thickness of the elastic layer. On the other hand, the maximum diameter of the specific aggregate is, for example, preferably 2% or more of the film thickness of the elastic layer.

From the viewpoint of suppressing offset, the maximum diameter of the specific aggregate is, for example, preferably 30 μm or less, more preferably 25 μm or less, still more preferably 20 μm or less, and particularly preferably 15 μm or less.

The lower limit of the maximum diameter of the specific aggregate is, for example, 8 μm or more.

The specific aggregate may be an aggregate in which plural fibrous carbons are entangled with each other and which has the maximum diameter described above, and a shape thereof is not particularly limited. The specific aggregate in the fixing belt may be, for example, spherical, elliptical spherical, or irregularly shaped.

Further, from the viewpoint of suppressing the offset, the ratio (minor axis Y/major axis X) of a minor axis Y to a major axis X of the specific aggregate in the elastic layer (1) is, for example, preferably 0.1 or more and 1.0 or less, more preferably 0.1 or more and 0.8 or less, and still more preferably 0.2 or more and 0.6 or less.

The maximum diameter, the major axis X, and the minor axis Y of the specific aggregate are measured by the following method.

The release layer is peeled off from the fixing belt, and the measurement is performed using a surface scanning electron microscope (SEM) image of the exposed elastic layer. For 10 random specific aggregates exposed on the surface, the length in the longitudinal direction and the length in the normal direction thereof are measured, and each arithmetic mean value of the 10 specific aggregates is set as a value of the maximum diameter (=major axis X) or the minor axis Y.

As a method of peeling the release layer from the fixing belt, for example, the same method as a measurement of the thermal conductivity to be described later may be used.

The fibrous carbon contained in the specific aggregate has a length of, for example, preferably 0.5 μm or more and 20 μm or less, more preferably 1 μm or more and 18 μm or less, and still more preferably 2 μm or more and 15 μm or less.

The fibrous carbon contained in the specific aggregate has a diameter of, for example, preferably 20 nm or more and 300 nm or less, more preferably 25 nm or more and 250 nm or less, and still more preferably 30 nm or more and 200 nm or less.

The length and the diameter of the fibrous carbon contained in the specific aggregate are measured by the following method.

The release layer is peeled off from the fixing belt, and the measurement is performed using a surface SEM image of the exposed elastic layer. For 10 random fibrous carbons in the specific aggregate exposed on the surface, the length and grist (thickness) are measured, and each arithmetic mean value of the 10 fibrous carbons is set as a value of the length or the diameter.

As a method of peeling the release layer from the fixing belt, for example, the same method as a measurement of the thermal conductivity to be described later may be used.

The number of the fibrous carbons contained in the specific aggregate may be plural (that is, two or more fibrous carbons), and is not particularly limited.

The fibrous carbons contained in the specific aggregate are, for example, preferably carbon nanotubes from the viewpoints of availability, thermal conductivity, and the like.

A content of the specific aggregate in the elastic layer (1) is, for example, preferably 0.1% by mass or more and 40% by mass or less, more preferably 5% by mass or more and 35% by mass or less, still more preferably 10% by mass or more and 35% by mass or less, and particularly preferably 10% by mass or more and 30% by mass or less, with respect to a total mass of the elastic layer.

The thermal conductivity of the elastic layer (1) is increased by increasing the content of the specific aggregate, and the offset is easily suppressed even in a case where fixing is performed at high speed. On the other hand, the shape followability of the fixing belt is increased by setting the content of the specific aggregate to 40% by mass or less with respect to the total mass of the elastic layer, and the offset is easily suppressed even in a case where a recording medium having a large surface unevenness is used.

Fibrous Carbons that are not Entangled with Each Other

For example, the elastic layer (1) preferably contains fibrous carbons that are not entangled with each other, in addition to the specific aggregates described above, from the viewpoint of further increasing the thermal conductivity.

That is, for example, the elastic layer (1) preferably contains the elastic material, the specific aggregate, and the fibrous carbons that are not entangled with each other.

The fibrous carbons that are not entangled with each other each have a length of, for example, preferably 0.5 μm or more and 100 μm or less, more preferably 2 μm or more and 80 μm or less, and still more preferably 3 μm or more and 60 μm or less.

The fibrous carbons that are not entangled with each other each have a diameter of, for example, preferably 20 nm or more and 300 nm or less, more preferably 25 nm or more and 250 nm or less, and still more preferably 30 nm or more and 200 nm or less.

The fibrous carbons that are not entangled with each other may be the same as or different from fibrous carbons contained in the specific aggregate (that is, the fibrous carbons configuring the specific aggregate).

The fibrous carbons that are not entangled with each other are, for example, preferably carbon nanotubes from the viewpoints of availability, thermal conductivity, and the like.

In a case where the elastic layer (1) contains the fibrous carbons that are not entangled with each other, a content thereof is, for example, preferably more than 0% by mass and not more than 20% by mass, more preferably more than 0.5% by mass and 15% by mass or less, and still more preferably 0.5% by mass or more and 10% by mass or less, with respect to a total mass of the elastic layer.

In the elastic layer (1), from the viewpoint of increasing the thermal conductivity of the belt, a content A of the specific aggregate and a content B of the fibrous carbons that are not entangled with each other, for example, preferably satisfy a relationship of A≥B on a mass basis.

Further, from the viewpoint of increasing the thermal conductivity of the belt, in the elastic layer (1), a ratio (A/(A+B)) of a content A of the specific aggregate to a total amount of the content A of the aggregate and a content B of the fibrous carbons that are not entangled with each other is, for example, preferably 0.50 or more and 0.95 or less on a mass basis.

The content A of the specific aggregate and the content B of the fibrous carbons that are not entangled with each other are measured by the following method.

The release layer is peeled off from the belt, and the contents are measured by an image analysis of a surface SEM image of the exposed elastic layer. A total area of the specific aggregates and a total area of the fibrous carbons that are not entangled with each other in the surface area of the exposed elastic layer are determined by image analysis of the surface SEM image. Here, the number of measurement samples (that is, the number of SEM images to be image-analyzed) is 5. The "content A of the specific aggregate" is the arithmetic mean value of the 5 samples of the "total area of the specific aggregates in the surface area of the elastic layer" determined by the above method. Also, the "content B of the fibrous carbons that are not entangled with each other" is the arithmetic mean value of 5 samples of the "total area of the fibrous carbons that are not entangled with each other, in the surface area of the elastic layer" determined by the above method.

Moreover, the ratio (A/(A+B)) is calculated from the "content A of the specific aggregate" and the "content B of the fibrous carbons that are not entangled with each other" obtained as described above. In a case of calculating the ratio (A/(A+B)), in a case where the specific aggregate and the fibrous carbons that are not entangled with each other have different specific gravities, the content A and the content B may be corrected using the respective specific gravities.

As a method of peeling the release layer from the fixing belt, for example, the same method as a measurement of the thermal conductivity to be described later may be used.

Elastic Material

Examples of the elastic material contained in the elastic layer (1) include a fluororesin, a silicone resin, a silicone rubber, a fluororubber, and a fluorosilicone rubber. Among these, as the elastic material, for example, the silicone rubber and the fluororubber are preferable, and the silicone rubber is more preferable, from the viewpoints of heat resistance, thermal conductivity, insulation, and the like.

Examples of the silicone rubber include RTV silicone rubber, HTV silicone rubber, and liquid silicone rubber. Specific examples thereof include polydimethyl silicone rubber (MQ), methyl vinyl silicone rubber (VMQ), methylphenyl silicone rubber (PMQ), and fluorosilicone rubber (FVMQ).

As the silicone rubber, for example, it is preferable to use a silicone rubber in which most of crosslinking-forms are addition reaction types. In addition, various types of functional groups are known for the silicone rubber. For example, dimethyl silicone rubber having a methyl group, methylphenyl silicone rubber having a methyl group and a phenyl group, and vinyl silicone rubber having a vinyl group (vinyl group-containing silicone rubber) are preferably used.

Further, as the silicone rubber, for example, a vinyl silicone rubber having a vinyl group is more preferable. For example, a silicone rubber having an organopolysiloxane structure having a vinyl group and a hydrogen organopolysiloxane structure having a hydrogen atom (SiH) bonded to a silicon atom is still more preferable.

Examples of the fluororubber include vinylidene fluoride rubber, ethylene/propylene tetrafluoride rubber, ethylene/perfluoromethyl tetrafluoride vinyl ether rubber, phosphazene rubber, and fluoropolyether.

The elastic material contains, for example, preferably silicone rubber as a major component (that is, contains 50% by mass or more of silicone rubber with respect to the total mass of the elastic material).

The content of the silicone rubber is, for example, more preferably 90% by mass or more, still more preferably 99% by mass or more, and may also be 100% by mass, with respect to the total mass of the elastic material used for the elastic layer (1).

Additive

The elastic layer may contain an additive, other than the components described above, such as an inorganic filler, a softening agent (such as a paraffin-based agent), a processing aid (such as stearic acid), an anti-aging agent (such as an amine-based agent), and a vulcanizing agent (such as sulfur, an metal oxide, and a peroxide), in addition to the specific aggregate and the fibrous carbons.

The thickness (film thickness) of the elastic layer in the first exemplary embodiment of the fixing belt according to the present disclosure is, for example, preferably 30 μm or more and 600 μm or less, and more preferably 100 μm or more and 500 μm or less.

Physical Property

Thermal Conductivity

The elastic layer (1) preferably has, for example, a high thermal conductivity.

Specifically, the thermal conductivity of the elastic layer is, for example, preferably 1.0 W/m·K or more and 4.5 W/m·K or less, more preferably 2.0 W/m·K or more and 4.5 W/m·K or less, and still more preferably 3.5 W/m·K or more and 4.5 W/m·K or less.

The thermal conductivity of the elastic layer is measured as follows.

First, after a notch is made with a cutter blade from a release layer side of the fixing belt to a release layer/elastic layer interface, the elastic layer is peeled off by grasping only the release layer by hand and pulling the elastic layer in a radial direction while rotating the belt. Thereafter, a cutter blade is inserted into the elastic layer/base material layer interface, and the blade is advanced in a horizontal direction with respect to the interface to peel off the base material layer.

The thermal conductivity of the elastic layer of the obtained subject is measured under a condition of a load of 50 g by a temperature wave analysis method using ai-phase (manufactured by ai-Phase Co.).

Young's Modulus

From the viewpoint of shape followability, the elastic layer (1) has a Young's modulus of, for example, preferably 0.2 MPa or more and 1.0 MPa or less, more preferably 0.2 MPa or more and 0.6 MPa or less, and still more preferably 0.2 MPa or more and 0.4 MPa or less.

The Young's modulus of the elastic layer is measured as follows.

First, the resin base material layer and the release layer are peeled off from the fixing belt in the same manner as in the measurement of the thermal conductivity.

Measurement is performed on the obtained elastic layer of the target with RHEOVIBRON (manufactured by ORIENTEC CO., LTD.) at an amplitude of 50 μm and a frequency of 10 Hz, and a value at 150° C. is used.

Formation of Elastic Layer (1)

A known method may be applied to form the elastic layer (1), for example, a coating method is applied.

In a case where the silicone rubber is used as the elastic material of the elastic layer, for example, first, an elastic layer-forming coating liquid containing a liquid silicone rubber that is cured by heating to become a silicone rubber is prepared. Next, the elastic layer-forming coating liquid is applied onto the base material layer to form a coating film, and as needed, the coating film is vulcanized to form an elastic layer on the base material layer. In the vulcanization of the coating film, the vulcanization temperature is, for example, 150° C. or higher and 250° C. or lower, and the vulcanization time is, for example, 30 minutes or longer and 120 minutes or shorter.

In a case of preparing the elastic layer-forming coating liquid, for example, the specific aggregate is preferably manufactured as well.

Specifically, examples of the method include a method in which a precursor liquid containing an elastic material and a fibrous carbon is prepared (also referred to as a precursor liquid preparation step), a specific aggregate is produced in a system of the precursor liquid (also referred to as a specific aggregate production step), and the coating liquid containing the elastic material and the specific aggregate is obtained.

Hereinafter, the precursor liquid preparation step and the specific aggregate production step will be described.

Precursor Liquid Preparation Step

In the precursor liquid preparation step, first, the fibrous carbon and a dispersion medium are mixed to prepare a dispersion liquid in which the fibrous carbons are dispersed.

Here, examples of the dispersion medium include an organic solvent that does not dissolve or is difficult to dissolve the fibrous carbon, and can dissolve the elastic material. For example, in a case where the silicone rubber is used as the elastic material, examples of the dispersion medium include butyl acetate, toluene, heptane, benzene, and acetone.

Here, the content of fibrous carbon in the dispersion liquid is 10% by mass or more and 40% by mass or less (for example, preferably 15% by mass or more and 30% by mass or less) with respect to the total mass of the dispersion liquid.

The obtained dispersion liquid is, for example, preferably subjected to a high-pressure dispersion treatment. By performing the high-pressure dispersion treatment, the fibrous carbon is loosened in the dispersion liquid and isolated individually, and further the length of the fibrous carbon in the dispersion liquid is adjusted.

Here, the conditions for the high-pressure dispersion treatment may be any condition under which the fibrous carbons are individually isolated and the length of the fibrous carbons may be adjusted to a target value. For example, the high-pressure dispersion treatment is preferably performed at a liquid temperature of the dispersion liquid of 30° C. or higher and 60° C. or lower and under a pressure of 20 MPa or more and 100 MPa or less (for example, preferably 40 MPa or higher and 80 MPa or lower).

For example, a high-pressure homogenizer is used for the high-pressure dispersion treatment.

The length of the fibrous carbon in the dispersion liquid is adjusted to, for example, preferably about 0.5 μm or more and 100 μm or less (for example, preferably 2 μm or more and 80 μm or less).

Here, the length of the fibrous carbon in the dispersion liquid may be measured by observation with an optical microscope or an electron microscope.

The maximum diameter of the specific aggregate may be controlled by the length of the fibrous carbon in the dispersion liquid. Specifically, as the fibrous carbon is longer, the aggregate having a larger maximum diameter tends to be produced.

In the precursor liquid preparation step, an elastic material is subsequently added to the dispersion liquid obtained as described above to prepare a precursor liquid.

The amount of the elastic material added is, for example, preferably set to about 10% by mass or more and 90% by mass or less (for example, preferably 15% by mass or more and 60% by mass or less) in terms of a solid content concentration with respect to the total mass of the precursor liquid.

Specific Aggregate Manufacturing Step

In the specific aggregate manufacturing step, the precursor liquid obtained in the precursor liquid preparation step is agitated with a planetary mixer to manufacture a specific aggregate in the system.

By agitating the precursor liquid with a planetary mixer, the fibrous carbons individually isolated in the precursor liquid are slowly entangled into a lump, and a specific aggregate is produced.

Here, a condition of agitating by the planetary mixer may be a condition under which a specific aggregate having a target maximum diameter may be obtained.

For example, as the condition of agitating, for example, it is preferable that the liquid temperature of the precursor liquid is 25° C. or higher and 40° C. or lower, and the agitating is, for example, preferably performed under the condition of 10 minutes or longer and 60 minutes or shorter with vacuuming.

The maximum diameter of the specific aggregate may be controlled by the condition of agitating. Specifically, as the time for agitating by the planetary mixer is longer, the aggregate having a larger maximum diameter tends to be produced.

In the specific aggregate production step, all of the fibrous carbons contained in the precursor liquid may become specific aggregates, and together with the specific aggregates, some of the fibrous carbons which do not form the specific aggregates (that is, the fibrous carbons that are not entangled with each other) may remain.

As described above, a mixture liquid containing the elastic material and the specific aggregate may be obtained.

By adding other components (such as fibrous carbons that are not entangled with each other and an additive) to the obtained mixture liquid, as needed, an elastic layer-forming coating liquid may be obtained. Further, the obtained mixture liquid may be diluted with an organic solvent to adjust viscosity or the like of the coating liquid.

Elastic Layer (2)

An elastic layer in the second exemplary embodiment of the fixing belt according to the present disclosure (that is, the elastic layer (2)) contains the elastic material and the fibrous carbon has a thermal conductivity of 1.0 W/m·K or more and 4.5 W/m·K or less, and has a Young's modulus of 0.2 MPa or more and 1.0 MPa or less.

The elastic layer (2), for example, preferably has a thermal conductivity of 1.0 W/m·K or more and 4.5 W/m·K or less and a Young's modulus of 0.2 MPa or more and 1.0 MPa or less, and for example, more preferably has a thermal conductivity of 2.0 W/m·K or more and 4.5 W/m·K or less, and the Young's modulus of 0.2 MPa or more and 0.6 MPa or less, from the viewpoint of suppressing the offset.

The elastic layer (2), for example, preferably contains an elastic material and a specific aggregate as the fibrous carbon, similarly to the elastic layer (1) described above, and for example, more preferably contains a resin, a specific aggregate, and fibrous carbons that are not entangled with each other.

Aspects of the resin, the specific aggregate, and the fibrous carbons that are not entangled with each other, which are contained in the elastic layer (2) are the same as the aspects of the resin, the specific aggregate, and the fibrous carbons that are not entangled with each other, which are contained in the elastic layer (1). Further, the contents of the resin, the specific aggregate, and the fibrous carbons that are not entangled with each other are, for example, preferably the same as the contents of the resin, the specific aggregate, and the fibrous carbons that are not entangled with each other in the elastic layer (1), respectively.

Further, the elastic layer (2) may contain an additive, similarly to the elastic layer (1) described above.

Further, the film thickness of the elastic layer (2) is the same as the film thickness of the elastic layer (1) described above.

In addition, as a method for forming the elastic layer (2), the same method as for the elastic layer (1) described above is applied.

Resin Base Material Layer

In the fixing belt according to the present disclosure, the resin base material layer is a layer containing a resin.

The content of the resin in the resin base material layer is, for example, preferably 50% by mass or more, more preferably 60% by mass or more, still more preferably 70% by mass or more, particularly preferably 80% by mass or more, and most preferably 90% by mass or more, with respect to a total mass of the resin base material layer.

Resin

The resin contained in the resin base material layer is, for example, preferably a heat-resistant resin.

Examples of the resin include a heat-resistant resin or the like with high heat resistance and high strength, such as a liquid crystal material such as polyimide, aromatic polyamide, and a thermotropic liquid crystal polymer. Polyester, polyethylene terephthalate, polyethersulfone, polyetherketone, polysulfone, polyimideamide, and the like are used in addition to the resins.

Among these, as the resin, for example, the polyimide is preferable.

Examples of the polyimide include an imidized product of a polyamic acid (precursor of a polyimide resin) which is a polymer of a tetracarboxylic acid dianhydride and a diamine compound. Specific examples of the polyimide include a resin obtained by polymerizing equimolar amounts of the tetracarboxylic acid dianhydride and the diamine compound in a solvent to obtain a polyamic acid solution, and then imidizing the polyamic acid.

Examples of the tetracarboxylic acid dianhydride include both an aromatic compound and an aliphatic compound. From the viewpoint of heat resistance, for example, the aromatic compound is preferable.

Examples of the aromatic tetracarboxylic acid dianhydride include pyromellitic acid dianhydride, 3,3',4,4'-benzophenone tetracarboxylic acid dianhydride, 3,3',4,4'-biphenyl sulfone tetracarboxylic acid dianhydride, 1,4,5,8-naphthalene tetracarboxylic acid dianhydride, 2,3,6,7-naphthalene tetracarboxylic acid dianhydride, 3,3',4,4'-biphenyl ether tetracarboxylic acid dianhydride, 3,3',4,4'-dimethyldiphenylsilane tetracarboxylic acid dianhydride, 3,3',4,4'-tetraphenylsilane tetracarboxylic acid dianhydride, 1,2,3,4-furantetracarboxylic acid dianhydride, 4,4'-bis(3,4-dicarboxyphenoxy) diphenylsulfide dianhydride, 4,4'-bis(3,4-dicarboxyphenoxy) diphenylsulfone dianhydride, 4,4'-bis(3,4-dicarboxyphenoxy) diphenylpropane dianhydride, 3,3',4,4'-perfluoroisopropylidene diphthalic acid dianhydride, 3,3',4,4'-biphenyl tetracarboxylic acid dianhydride, 2,3,3',4'-biphenyl tetracarboxylic acid dianhydride, bis(phthalic acid) phenylphosphine oxide dianhydride, p-phenylene-bis(triphenylphthalic acid) dianhydride, m-phenylene-bis(triphenylphthalic acid) dianhydride, bis(triphenylphthalic acid)-4,4'-diphenyl ether dianhydride, and bis(triphenylphthalic acid)-4,4'-diphenyl methane dianhydride.

Examples of the aliphatic tetracarboxylic acid dianhydride include an aliphatic or alicyclic tetracarboxylic acid dianhydride such as butanetetracarboxylic acid dianhydride, 1,2,3,4-cyclobutanetetracarboxylic acid dianhydride, 1,3-dimethyl-1,2,3,4-dyclobutanetetracarboxylic acid dianhydride, 1,2,3,4-cyclopentanetetracarboxylic acid dianhydride, 2,3,5-tricarboxycyclopentylacetic acid dianhydride, 3,5,6-tricarboxyorbornane-2-acetic acid dianhydride, 2,3,4,5-tetrahydrofuran tetracarboxylic acid dianhydride, 5-(2,5-dioxotetrahydrofuryl)-3-methyl-3-cyclohexene-1,2-dicarboxylic acid dianhydride, and bicyclo[2,2,2]-oct-7-ene-2,3,5,6-tetracarboxylic acid dianhydrides; and an aliphatic tetracarboxylic dianhydride having an aromatic ring such as 1,3,3a,4,5,9b-hexahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl)-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

Among these, as the tetracarboxylic acid dianhydride, the aromatic tetracarboxylic acid dianhydride may be used. Specifically, for example, the pyromellitic acid dianhydride, the 3,3',4,4'-biphenyl tetracarboxylic acid dianhydride, the 2,3,3',4'-biphenyl tetracarboxylic acid dianhydride, the 3,3',4,4'-biphenyl ether tetracarboxylic acid dianhydride, and the 3,3',4,4'-benzophenone tetracarboxylic acid dianhydride may be used. Further, pyromellitic acid dianhydride, the 3,3',4,4'-biphenyl tetracarboxylic acid dianhydride, and the 3,3',4,4'-benzophenone tetracarboxylic acid dianhydride may be used. In particular, the 3,3',4,4'-biphenyl tetracarboxylic acid dianhydride may be used.

The tetracarboxylic acid dianhydride may be used alone or two or more kinds thereof may be used in combination.

Further, in a case where two or more kinds of the tetracarboxylic acid dianhydrides are used in combination, each of the aromatic tetracarboxylic acid dianhydrides and the aliphatic tetracarboxylic acid dianhydrides may be used in combination, and the aromatic tetracarboxylic acid dianhydride and the aliphatic tetracarboxylic acid dianhydride may be combined.

On the other hand, the diamine compound is a diamine compound having two amino groups in a molecular structure. Examples of the diamine compound include both an aromatic compound and an aliphatic compound, and for example, the aromatic compound is preferable.

Examples of the diamine compound include an aromatic diamine such as p-phenylenediamine, m-phenylenediamine, 4,4'-diaminodiphenylmethane, 4,4'-diaminodiphenylethane, 4,4'-diaminodiphenyl ether, 4,4'-diaminodiphenyl sulfide, 4,4'-diaminodiphenyl sulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl) hexafluoropropane, 4,4'-methylene-bis(2-chloroaniline), 2,2', 5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenylene isopropylidene) bisaniline, 4,4'-(m-phenylene isopropylidene)bisaniline, 2,2'-bis[4-(4-amino-2-trifluoromethylphenoxy)phenyl] hexafluoropropane, and 4,4'-bis[4-(4-amino-2-trifluoromethyl)phenoxy]-octafluorobiphenyl; an aromatic diamine, having two amino groups bonded to an aromatic ring and a hetero atom other than a nitrogen atom of the amino groups, such as diaminotetraphenylthiophene; and an aliphatic diamine and an alicyclic diamine such as 1,1-m-xylylenediamine, 1,3-propane diamine, tetramethylenediamine, pentamethylenediamine, octamethylenediamine, nonamethylenediamine, 4,4-diaminoheptamethylenediamine, 1,4-diaminocyclohexane, isophorone diamine, tetrahydrodicyclopentadienylenediamine, hexahydro-4,7-methanoin danylene dimethylenediamine, tricyclo[6,2,1,$0^{2,7}$]-undecylenic methyldiamine, and 4,4'-methylene bis(cyclohexylamine).

Among these, as the diamine compound, the aromatic diamine compound may be used. Specifically, for example, the p-phenylenediamine, the m-phenylenediamine, the 4,4'-diaminodiphenylmethane, the 4,4'-diaminodiphenyl ether, the 3,4'-diaminodiphenyl ether, the 4,4'-diaminodiphenyl sulfide, and the 4,4'-diaminodiphenyl sulfone may be used. In particular, the 4,4'-diaminodiphenyl ether and the p-phenylenediamine may be used.

The diamine compound may be used alone or two or more kinds thereof may be used in combination.

In addition, in a case where two or more kinds of the diamine compound are used in combination, each of the aromatic diamine compounds and the aliphatic diamine compounds may be used in combination, and the aromatic diamine compound and the aliphatic diamine compound may be combined.

Among these, from the viewpoint of heat resistance, the polyimide is, for example, preferably the aromatic polyimide (specifically, an imidized product of a polyamic acid (precursor of a polyimide resin) which is a polymer of an aromatic tetracarboxylic acid dianhydride and an aromatic diamine compound.

The aromatic polyimide is, for example, more preferably a polyimide having a structural unit represented by the following General Formula (PI1).

(PI1)

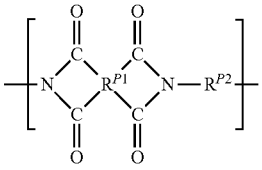

In General Formula (PI1), $R^{P1}$ represents a phenyl group or a biphenyl group, and $R^{P2}$ represents a divalent aromatic group.

Examples of the divalent aromatic group represented by $R^{P2}$ include a phenylene group, a naphthyl group, a biphenyl group, and a diphenyl ether group. From the viewpoint of bending durability, as the divalent aromatic group, for example, the phenylene group and the biphenyl group are preferable.

The number average molecular weight of the polyimide may be 5,000 or more and 100,000 or less, for example, more preferably 7,000 or more and 50,000 or less, and still more preferably 10,000 or more and 30,000 or less.

The number average molecular weight of the polyimide is measured by a gel permeation chromatography (GPC) method under the following measurement conditions.

Column: Tosoh TSK gel α-M (7.8 mm ID×30 cm)

Eluent: DMF (dimethylformamide)/30 mM LiBr/60 mM phosphoric acid

Flow velocity: 0.6 mL/min

Injection amount: 60 μL

Detector: RI (differential refractive index detector)

The film thickness of the resin base material layer is, for example, preferably 30 μm or more and 200 μm or less, more preferably 50 μm or more and 150 μm or less, and particularly preferably 70 μm or more and 120 μm or less, from the viewpoints of thermal conductivity and mechanical strength.

Formation of Resin Base Material Layer

A base material layer-forming coating liquid containing a resin and an additive to be used as needed is prepared, and the obtained base material layer-forming coating liquid is applied onto a cylindrical base material, and dried to obtain the resin base material layer.

In a case where the resin is polyimide, a base material layer-forming coating liquid containing a polyamic acid (precursor of a polyimide resin) and an additive to be used as needed is prepared, and the obtained base material layer-forming coating liquid is applied onto a cylindrical base material and is fired (that is, imidized) to obtain the resin base material layer.

Release Layer

The fixing belt according to the present disclosure has the release layer on the elastic layer.

The release layer is a layer that plays a role of suppressing the toner image in a molten state from sticking to the surface (outer peripheral surface) on a side in contact with the recording medium at the time of fixing.

The release layer is required to have, for example, heat resistance and releasability. From the viewpoint, for the material configuring the release layer, for example, a heat-resistant release material is preferably used, and specific examples thereof include fluororubber, fluororesin, silicone resin, and polyimide resin.

Among these, the fluororesin may be used as the heat-resistant release material.

Specific examples of the fluororesin include a tetrafluoroethylene-perfluoroalkyl vinyl ether copolymer (PFA), polytetrafluoroethylene (PTFE), a tetrafluoroethylene-hexafluoropropylene copolymer (FEP), a polyethylene-tetrafluoro ethylene copolymer (ETFE), polyvinylidene fluoride (PVDF), polychlorotrifluoroethylene (PCTFE), and vinyl fluoride (PVF).

The surface of the release layer on the elastic layer side may be subjected to a surface treatment. The surface treatment may be a wet treatment or a dry treatment, and examples thereof include a liquid ammonia treatment, an excimer laser treatment, and a plasma treatment.

The thickness of the release layer is, for example, preferably 10 μm or more and 100 μm or less, and more preferably 20 μm or more and 50 μm or less.

A known method may be applied to form the release layer, and for example, a coating method may be applied.

Further, the release layer may be formed by preparing a tubular surface layer in advance and coating the outer periphery of the elastic layer with the release layer. An adhesive layer (for example, an adhesive layer containing a silane coupling agent having an epoxy group) may be formed on an inner surface of the tubular release layer and then the outer periphery may be coated therewith.

The film thickness of the fixing belt according to the present disclosure is, for example, preferably 0.06 mm or more and 0.90 mm or less, more preferably 0.15 mm or more and 0.70 mm or less, and further preferably 0.10 mm or more and 0.60 mm or less.

Use of Fixing Belt Member

The fixing belt according to the present disclosure is, for example, applied to both a heating belt and a pressure belt. The heating belt may be either a heating belt that performs heating by an electromagnetic induction method or a heating belt that performs heating from an external heat source.

However, in a case where the fixing belt according to the present disclosure is applied to a heating belt that performs heating by an electromagnetic induction method, a metal layer (a heating layer) that generates heat by electromagnetic induction may be provided between the base material layer and the elastic layer.

Fixing Device

The fixing device according to the present disclosure has various configurations, for example, may include a fixing device including a first rotating body and a second rotating body arranged in contact with the outer surface of the first rotating body, in which a toner image is fixed by inserting a recording medium having the toner image formed on a surface into a contact portion between the first rotating body and the second rotating body. Then, the fixing belt according to the present disclosure is applied as least one of the first rotating body or the second rotating body.

Hereinafter, regarding the fixing device according to the present disclosure, a fixing device including the heating roll and the pressure belt as the first exemplary embodiment, a fixing device including the heating belt and the heating roll as the second exemplary embodiment, and an electromagnetic induction heating type fixing device including a heating belt and a heating roll as the third exemplary embodiment will be described. Then, in the first and second exemplary embodiments, the fixing belt according to the present disclosure may be applied to both the heating belt and the pressure belt.

The fixing device according to the present disclosure is not limited to the first to third exemplary embodiments, and may be a fixing device including a heating roll or a heating belt and a pressure belt. The fixing belt according to the present disclosure may be applied to both the heating belt and the pressure belt.

First Exemplary Embodiment of Fixing Device

Figure 2:
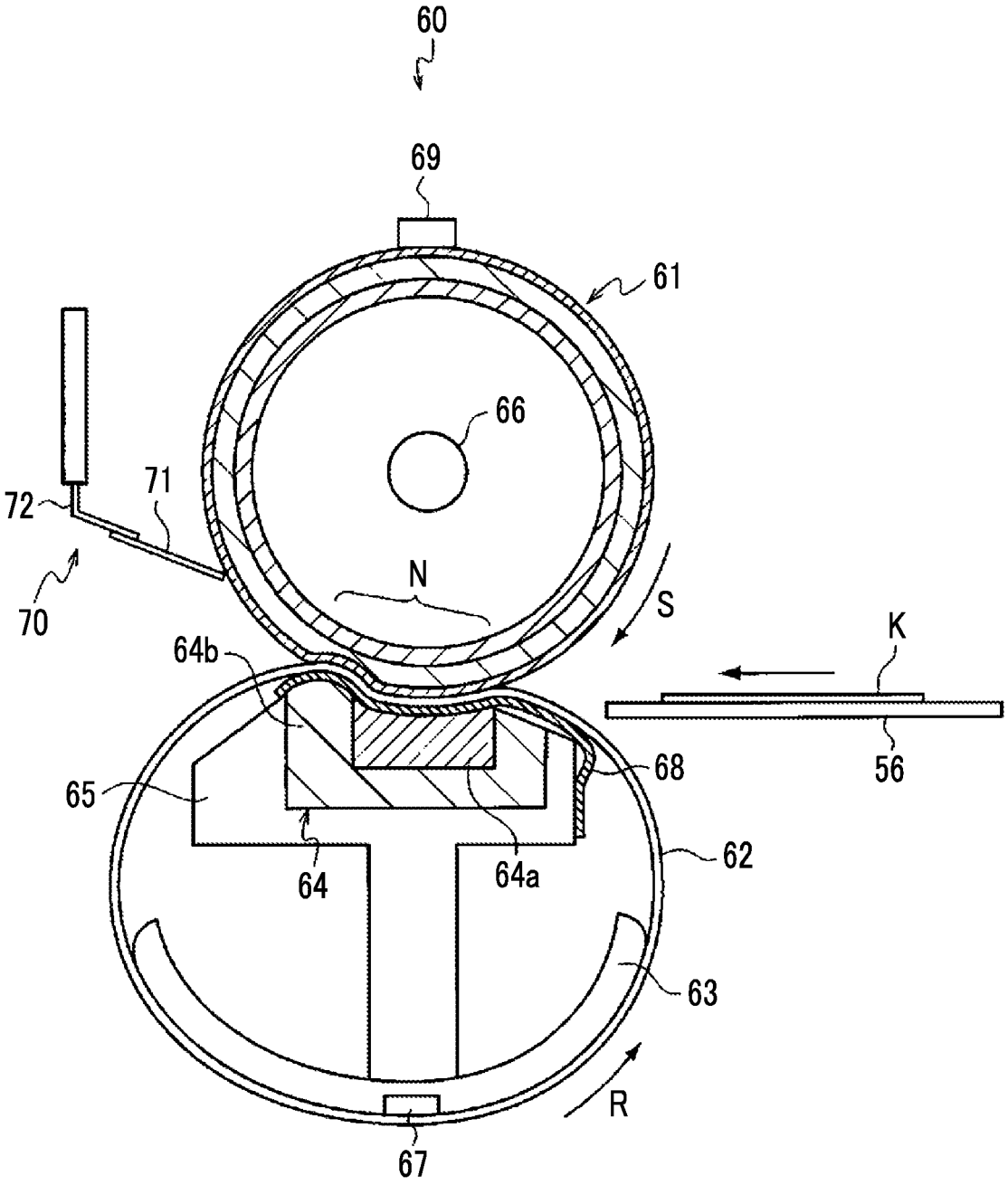
FIG. 2 is a schematic configuration diagram showing an example of a first exemplary embodiment of the fixing device according to the present disclosure.

The first exemplary embodiment of the fixing device will be described with reference to FIG. 2. FIG. 2 is a schematic diagram showing an example of a first exemplary embodiment of the fixing device (that is, a fixing device 60).

As shown in FIG. 2, the fixing device 60 is configured to include, for example, a heating roll 61 (an example of a first rotating body) driven to rotate, a pressure belt 62 (an example of a second rotating body), and a pressing pad 64 (an example of pressing member) that presses the heating roll 61 via the pressure belt 62.

Regarding the pressing pad 64, for example, the pressure belt 62 and the heating roll 61 may be relatively pressed. Therefore, a pressure belt 62 side may be pressed to the heating roll 61, and a heating roll 61 side may be pressed to the pressure belt 62.

A halogen lamp 66 (an example of heating unit) is arranged inside the heating roll 61. The heating unit is not limited to the halogen lamp, and other heat-generating members that generate heat may be used.

On the other hand, for example, a temperature sensitive element 69 is arranged in contact with the surface of the heating roll 61. The lighting of the halogen lamp 66 is controlled based on a temperature measurement value by the temperature sensitive element 69, and a surface temperature of the heating roll 61 is maintained at a target set temperature (for example, 150° C.)

The pressure belt 62 is rotatably supported by, for example, a pressing pad 64 arranged therein and a belt traveling guide 63. In a sandwiching region N (nip portion), the pressure belt is arranged by being pressed against the heating roll 61 by the pressing pad 64.

The pressing pad 64 is arranged in a state of being pressed to the heating roll 61 via the pressure belt 62 inside the pressure belt 62, and forms a sandwiching region N with the heating roll 61, for example.

In the pressing pad 64, for example, a front sandwiching member 64*a* for securing a wide sandwiching region N is arranged on an inlet side of the sandwiching region N, and a peeling sandwiching member 64*b* for giving distortion to the heating roll 61 is arranged on an outlet side of the sandwiching region N.

In order to reduce sliding resistance between an inner peripheral surface of the pressure belt 62 and the pressing pad 64, for example, a sheet-like sliding member 68 is provided on a surface of the front sandwiching member 64*a* and the peeling sandwiching member 64*b* in contact with the pressure belt 62. The pressing pad 64 and the sliding member 68 are held by a metal holding member 65.

The sliding member 68 is provided, for example, so that a sliding surface thereof is in contact with an inner peripheral surface of the pressure belt 62, and is involved in holding and supplying an oil existing between the sliding member 68 and the pressure belt 62.

For example, a belt traveling guide 63 is attached to the holding member 65, and the pressure belt 62 is configured to rotate.

The heating roll 61 rotates in a direction of an arrow S by a drive motor (not shown), and the pressure belt 62 rotates by being driven the rotation of the heating roll 61, in a direction of an arrow R opposite to the rotation direction of the heating roll 61. That is, for example, the heating roll 61 rotates clockwise in FIG. 2, while the pressure belt 62 rotates counterclockwise.

Then, paper K (an example of the recording medium) having an unfixed toner image is guided by, for example, the fixing inlet guide 56 and transported to the sandwiching region N. When the paper K passes through the sandwiching region N, the unfixed toner image on the paper K is fixed by the pressure and heat acting on the sandwiching region N.

In the fixing device 60, for example, a concave front sandwiching member 64*a* that follows the outer peripheral surface of the heating roll 61 secures a wider sandwiching region N as compared with a configuration without the front sandwiching member 64*a*.

Further, for example, by arranging the peeling sandwiching member 64*b* so as to protrude from the outer peripheral surface of the heating roll 61, the fixing device 60 is configured such that the strain of the heating roll becomes locally large in the outlet region of the sandwiching region N.

In a case where the peeling sandwiching member 64*b* is arranged in this manner, for example, the paper K after fixing passes through locally large formed strain when passing through the peeling sandwiching region, and thus the paper K is easy to be peeled off from the heating roll 61.

As an auxiliary unit for peeling, for example, a peeling member 70 is arranged on a downstream side of the sandwiching region N of the heating roll 61. The peeling member 70 is, for example, held by the holding member 72 in a state where a peeling claw 71 is close to the heating roll in a direction facing the rotation direction of the heating roll 61 (counter direction).

Second Exemplary Embodiment of Fixing Device

Figure 3:
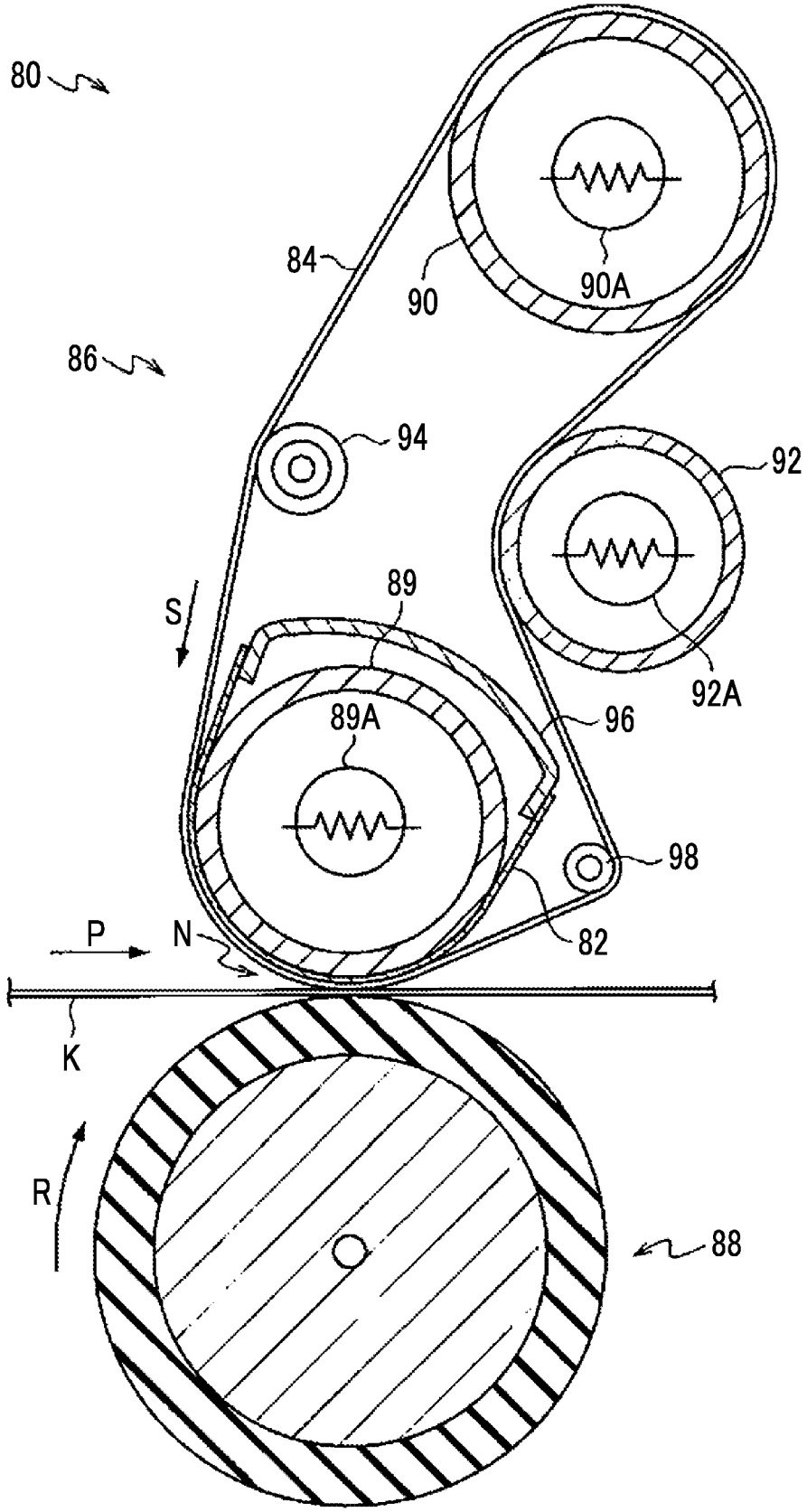
FIG. 3 is a schematic configuration diagram showing an example of a second exemplary embodiment of the fixing device according to the present disclosure.

A second exemplary embodiment of the fixing device will be described with reference to FIG. 3. FIG. 3 is a schematic diagram showing an example of a second exemplary embodiment of the fixing device (that is, a fixing device 80).

As shown in FIG. 3, the fixing device 80 is configured to include, for example, a fixing belt module 86 including a heating belt 84 (an example of the first rotating body) and a pressure roll 88 (an example of the second rotating body) arranged by being pressed to the heating belt 84 (the fixing belt module 86). For example, the sandwiching region N (nip portion) is formed in a contact portion between the heating belt 84 (fixing belt module 86) and the pressure roll 88. In the sandwiching region N, the paper K (an example of the recording medium) is pressed and heated, and the toner image is fixed.

The fixing belt module 86 includes, for example, an endless heating belt 84, a heating pressing roll 89 around which the heating belt 84 is wound on the pressure roll 88 side, and which is rotationally driven by the rotational force of a motor (not shown) and presses the heating belt from an inner peripheral surface thereof toward the pressure roll 88, and a support roll 90 that supports the heating belt 84 from the inside at a position different from the heating pressing roll 89.

The fixing belt module 86 is, for example, provided with a support roll 92 that is arranged outside the heating belt 84 and defines a circuit path thereof, and a posture correction roll 94 that corrects the posture of the heating belt 84 from the heating pressing roll 89 to the support roll 90, and a support roll 98 that applies tension to the heating belt 84 from the inner peripheral surface on the downstream side of the sandwiching region N formed by the heating belt 84 and the pressure roll 88.

The fixing belt module 86 is provided, for example, so that a sheet-shaped sliding member 82 is interposed between the heating belt 84 and the heating pressing roll 89.

The sliding member 82 is provided, for example, so that a sliding surface thereof is in contact with an inner peripheral surface of the heating belt 84, and is involved in holding and supplying an oil existing between the sliding member 82 and the heating belt 84.

Here, the sliding member 82 is provided, for example, in a state where both ends thereof are supported by the support member 96.

Inside the heating pressing roll 89, for example, a halogen heater 89A (an example of heating unit) is provided.

The support roll 90 is, for example, a cylindrical roll formed of aluminum, and a halogen heater 90A (an example of heating unit) is arranged inside, so that the heating belt 84 is heated from the inner peripheral surface side.

At both ends of the support roll 90, for example, spring members (not shown) that press the heating belt 84 outward are arranged.

The support roll 92 is, for example, a cylindrical roll made of aluminum, and a release layer consisting of a fluororesin having a thickness of 20 μm is formed on a surface of the support roll 92.

The release layer of the support roll 92 is formed, for example, to prevent a toner or a paper dust from the outer peripheral surface of the heating belt 84 from accumulating on the support roll 92.

For example, a halogen heater 92A (an example of the heating unit) is arranged inside the support roll 92 so that the heating belt 84 is heated from the outer peripheral surface side.

That is, for example, the heating pressing roll 89, the support roll 90, and the support roll 92 are configured to heat the heating belt 84.

The posture correction roll 94 is, for example, a columnar roll formed of aluminum, and an end position measurement mechanism (not shown) for measuring the end position of the heating belt 84 is arranged in the vicinity of the posture correction roll 94.

The posture correction roll 94 is provided with, for example, an axial displacement mechanism (not shown) that displaces a contact position of the heating belt 84 in an axial direction according to the measurement result of the end position measuring mechanism, and is configured to control meandering of the heating belt 84.

On the other hand, the pressure roll 88 is provided, for example, rotatably supported, and the heating belt 84 is provided by being pressed against a portion wound around the heating pressing roll 89 by an urging unit such as a spring (not shown). As a result, as the heating belt 84 (heating pressing roll 89) of the fixing belt module 86 rotates in a direction of an arrow S, the pressure roll 88 follows the heating belt 84 (heating pressing roll 89) and moves in a direction of an arrow R.

Then, the paper K having the unfixed toner image (not shown) is transported in a direction of the arrow P and guided to the sandwiching region N of the fixing device 80. When the paper K passes through the sandwiching region N, the unfixed toner image on the paper K is fixed by the pressure and heat acting on the sandwiching region N.

In the fixing device 80, a form in which the halogen heater (halogen lamp) is adopted as an example of plural heating units has been described, but the present disclosure is not limited thereto. A radiation lamp heating element (a heating element that generates radiation (such as infrared rays) and a resistance heating element (heating element that generates Joule heat by passing an electric current through a resistor: for example, a ceramic substrate formed with a film having resistance and fired) may be adopted.

Third Exemplary Embodiment of Fixing Device

Figure 4:
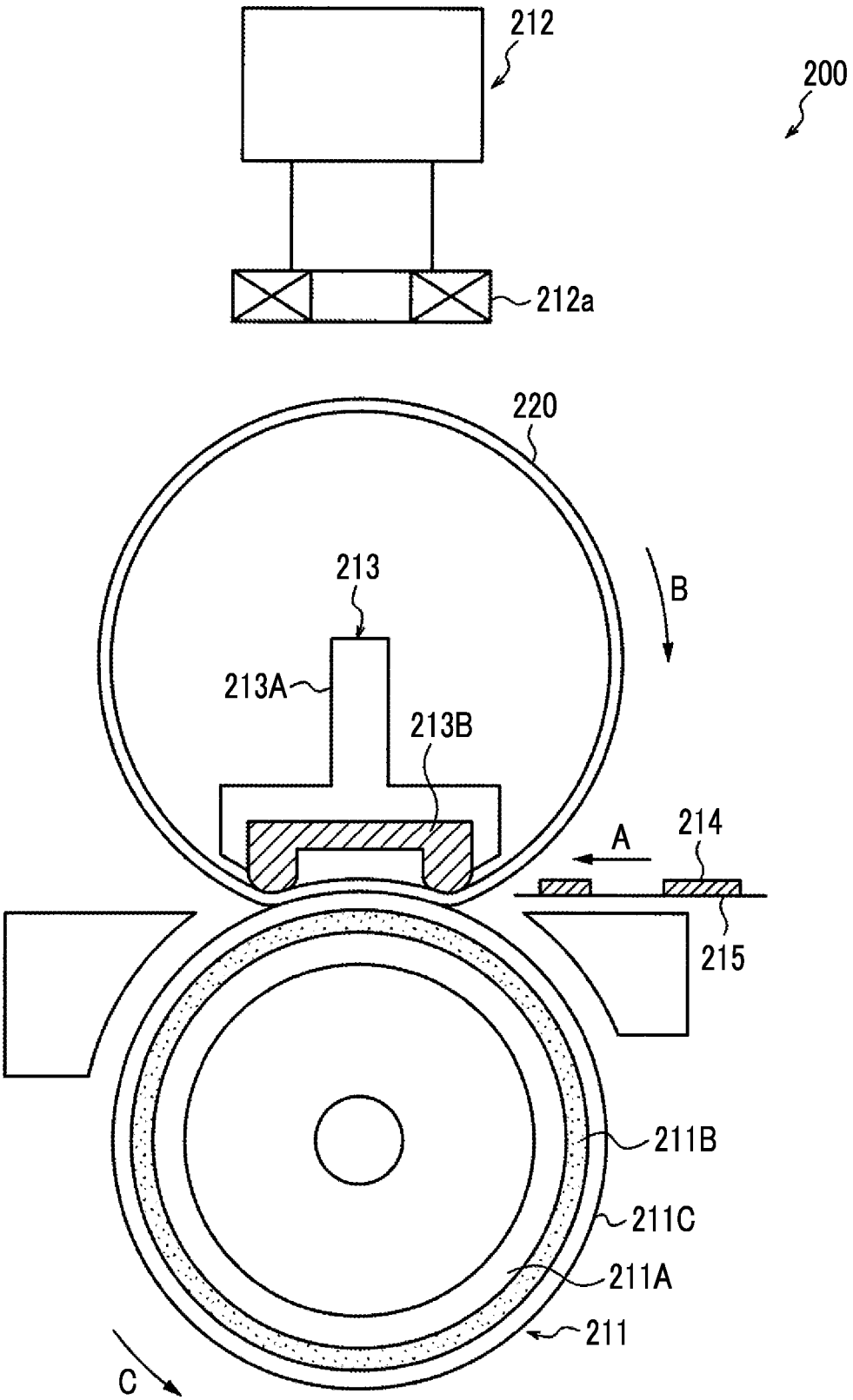
FIG. 4 is a schematic configuration diagram showing an example of a third exemplary embodiment of the fixing device according to the present disclosure.

A third exemplary embodiment of the fixing device will be described with reference to FIG. 4. FIG. 4 is a schematic diagram showing an example of a third exemplary embodiment of the fixing device (that is, a fixing device 200).

The fixing device 200 is an electromagnetic induction type fixing device including a belt 220 in a case where the belt 220 has a metal layer. In the fixing device 200, the belt 220 is used as the fixing belt according to the present disclosure.

As shown in FIG. 4, a pressure roll (pressure member) 211 is arranged so as to press a part of the belt 220, and a contact region (nip) between the belt 220 and a pressure roll 211 is formed from the viewpoint of efficient fixing. The belt 220 is curved along the peripheral surface of the pressure roll 211. Further, from the viewpoint of securing the releasability of the recording medium, a bent portion in which the belt bends is formed at an end of the contact region (nip).

The pressure roll 211 is configured by forming an elastic layer 211B made of silicone rubber or the like on a base material 211A, and further forming a release layer 211C made of a fluorine-based compound on an elastic layer 211B.

Inside the belt 220, a facing member 213 is arranged at a position facing the pressure roll 211. The facing member 213 consists of metal, heat-resistant resin, heat-resistant rubber, or the like, and includes a pad 213B that is in contact with the inner peripheral surface of the belt 220 to locally increase the pressure, and a support 213A that supports the pad 213B.

An electromagnetic induction heating device 212 having a built-in electromagnetic induction coil (excitation coil) 212*a* is provided at a position facing the pressure roll 211 (an example of the pressure member) about the belt 220. The electromagnetic induction heating device 212 changes a magnetic field to be generated, with an exciting circuit by applying an alternating current to the electromagnetic induction coil, and generates an eddy current in a metal layer (for example, an electromagnetic induction metal layer) (not shown) of the belt 220. This eddy current is converted into heat (Joule heat) by the electrical resistance of a metal layer (not shown), and as a result, the surface of the belt 220 generates heat.

The position of the electromagnetic induction heating device 212 is not limited to the position shown in FIG. 4, and, for example, may be installed on the upstream side of the contact region of the belt 220 in a rotation direction B, or inside the belt 220.

In the fixing device 200, the driving force is transmitted by a driving device to the gear fixed to the end of the belt 220, so that the belt 220 self-rotates in a direction of arrow B, and as the belt 220 rotates, the pressure roll 211 rotates in an opposite direction, that is, in a direction of an arrow C.

The recording medium 215 on which the unfixed toner image 214 is formed passes through the contact region (nip) between the belt 220 and the pressure roll 211 in the fixing device 200 in the direction of an arrow A, and pressure is applied to the unfixed toner image 214 in a molten state to fix the image to the recording medium 215.

Image Forming Apparatus

Next, the image forming apparatus according to the present disclosure will be described.

The image forming apparatus according to the present disclosure includes an image holder; a charging unit that charges a surface of the image holder; an electrostatic latent image forming unit that forms an electrostatic latent image on the charged surface of the image holder; a developing unit that develops the electrostatic latent image formed on the surface of the image holder by a developer containing a toner to form a toner image; a transfer unit that transfers the toner image to a surface of a recording medium; and a fixing unit that fixes the toner image to the recording medium.

As the fixing unit, the fixing device according to the present disclosure is adopted.

Here, in the image forming apparatus according to the present disclosure, the fixing device may be made into a cartridge so as to be attached to and detached from the image forming apparatus. That is, the image forming apparatus according to the present disclosure may include the fixing device according to the present disclosure as a configuring device of a process cartridge.

Hereinafter, the image forming apparatus according to the present disclosure will be described with reference to the drawings.

Figure 5:
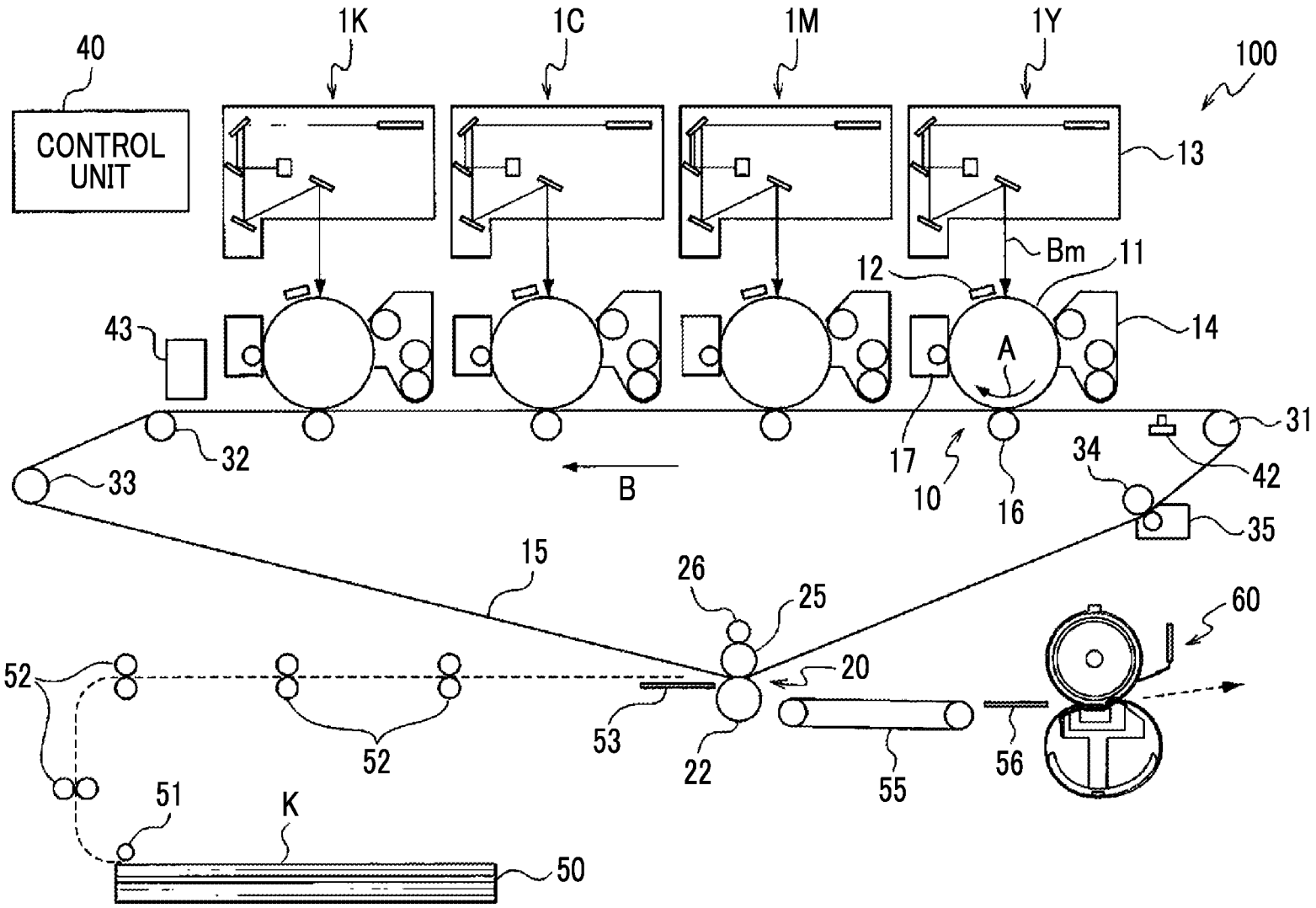
FIG. 5 is a schematic configuration diagram showing an example of an image forming apparatus according to the present disclosure.

FIG. 5 is a schematic configuration diagram showing an example of an image forming apparatus according to the present disclosure.

As shown in FIG. 5, the image forming apparatus 100 according to the present disclosure is, for example, an intermediate transfer type image forming apparatus generally called a tandem type, and includes: plural image forming units 1Y, 1M, 1C, and 1K in which each color component toner image is formed by electrophotographic method; a primary transfer unit 10 that sequentially transfers (primary transfer) each color component toner image formed by each of the image forming units 1Y, 1M, 1C, and 1K to an intermediate transfer belt 15; a secondary transfer unit 20 that collectively transfers (secondary transfer) superimposed toner image transferred on the intermediate transfer belt 15 to paper K, which is a recording medium; and a fixing device 60 that fixes a secondary transferred image on the paper K. Further, the image forming apparatus 100 has a control unit 40 that controls an operation of each device (each unit).

The fixing device 60 is the first exemplary embodiment of the fixing device described above. The image forming apparatus 100 may be configured to include the second exemplary embodiment of the fixing device described above.

Each of the image forming units 1Y, 1M, 1C, and 1K of the image forming apparatus 100 includes a photoconductor 11 that rotates in the direction of the arrow A as an example of an image holder that holds a toner image formed on the surface.

Around the photoconductor 11 as an example of a charging unit, a charger 12 that charges the photoconductor is provided and a laser exposure machine 13 (in the drawing, an exposure beam is indicated by the reference numeral Bm) that writes an electrostatic latent image on the photoconductor 11 as an example of the latent image forming unit is provided.

Further, around the photoconductor 11, a developing machine 14 in which each color component toner is accommodated and the electrostatic latent image on the photoconductor 11 is visualized by a toner is provided as an example of the developing unit, and a primary transfer roll 16 that transfers the toner image of each color component formed on the photoconductor 11 to the intermediate transfer belt 15 by the primary transfer unit 10.

Further, around the photoconductor 11, a photoconductor cleaner 17 that removes a residual toner on the photoconductor 11 is provided, and electrophotographic devices of the charger 12, the laser exposure machine 13, the developing machine 14, the primary transfer roll 16, and the photoconductor cleaner 17 are sequentially provided along the rotation direction of the photoconductor 11. These image forming units 1Y, 1M, 1C, and 1K are arranged substantially linearly in the order of yellow (Y), magenta (M), cyan (C), and black (K) from the upstream side of the intermediate transfer belt 15.

The intermediate transfer belt 15 which is an intermediate transfer body is configured of a film-shaped pressure belt in which a resin such as polyimide or polyamide is used as a base layer and an appropriate amount of an antistatic agent such as carbon black is contained. The intermediate transfer belt is formed to have a volume resistivity of $10^6$ Ωcm or more and $10^{14}$ Ωcm or less, and is configured to have a thickness of, for example, about 0.1 mm.

The intermediate transfer belt 15 is circulated (rotated) by various rolls in a B direction shown in FIG. 5 at a speed appropriate for the purpose. Examples of the various rolls include: a drive roll 31 that is driven by a motor (not shown) having excellent constant speed to rotate the intermediate transfer belt 15; a support roll 32 that supports the intermediate transfer belt 15 extending substantially linearly along the arrangement direction of each photoconductor 11; a tension applying roll 33, which applies tension to the intermediate transfer belt 15 and functions as a correction roll for preventing the intermediate transfer belt 15 from meandering; a back surface roll 25 provided on the secondary transfer unit 20; and a cleaning back surface roll 34 provided in the cleaning portion that scraps off the residual toner on the intermediate transfer belt 15.

The primary transfer unit 10 is configured of the primary transfer roll 16 arranged so as to face the photoconductor 11 with the intermediate transfer belt 15 interposed therebetween. The primary transfer roll 16 is configured of a core body and a sponge layer as an elastic layer fixed around the core body. The core body is a cylindrical rod made of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Then, the primary transfer roll 16 is arranged to be in contact with the photoconductor 11 with the intermediate transfer belt 15 interposed therebetween, and is configured such that the primary transfer roll 16 has a charging polarity (minus polarity) of the toner and the same applies below) and the opposite polarity voltage (primary transfer bias) are applied. As a result, the toner images on the respective photoconductors 11 are sequentially electrostatically attracted to the intermediate transfer belt 15, and the superimposed toner images are formed on the intermediate transfer belt 15.

The secondary transfer unit 20 is configured to include the back surface roll 25 and the secondary transfer roll 22 arranged on the toner image holding surface side of the intermediate transfer belt 15.

In the back surface roll 25, the surface is configured of a tube of the blended rubber of EPDM and NBR rubber in which carbon is dispersed, and the inside is configured of EPDM rubber. Then, the back surface roll is formed to have the surface resistivity of $10^7$Ω/□ or more and $10^{10}$Ω/□ or less, and the hardness is set to, for example, 70° (ASKER C: manufactured by KOBUNSHI KEIKI Co., Ltd., the same applies below). The back surface roll 25 is arranged on the back surface side of the intermediate transfer belt 15 to configure a counter electrode of the secondary transfer roll 22, and a power feeding roll 26 made of metal to which the secondary transfer bias is stably applied is contact-arranged.

The secondary transfer roll 22 is configured of a core body and a sponge layer as an elastic layer fixed around the core body. The core body is a cylindrical rod configured of a metal such as iron or SUS. The sponge layer is a sponge-like cylindrical roll which is formed of a blended rubber of NBR, SBR, and EPDM containing a conductive agent such as carbon black and has the volume resistivity of $10^{7.5}$ Ωcm or more and $10^{8.5}$ Ωcm or less.

Moreover, the secondary transfer roll 22 is arranged to be in contact with the back surface roll 25 with the intermediate transfer belt 15 interposed therebetween, and the secondary transfer roll 22 is grounded to form a secondary transfer bias with the back surface roll 25. The toner image is secondarily transferred onto the paper K transported to the secondary transfer unit 20.

Further, on the downstream side of the secondary transfer unit 20 of the intermediate transfer belt 15, an intermediate transfer belt cleaner 35 that cleans the surface of the intermediate transfer belt 15 by removing residual toner or paper dust on the intermediate transfer belt 15 after the secondary transfer is provided so as to be detachable from the intermediate transfer belt 15.

The intermediate transfer belt 15, the primary transfer unit 10 (primary transfer roll 16), and the secondary transfer unit 20 (secondary transfer roll 22) correspond to an example of the transfer unit.

On the other hand, on the upstream side of the yellow image forming unit 1Y, a reference sensor (home position sensor) 42 that generates a reference signal as a reference for taking the image forming timing in each of the image forming units 1Y, 1M, 1C, and 1K is provided. The reference sensor 42 recognizes a mark provided on the back side of the intermediate transfer belt 15 and generates a reference signal. According to an instruction from the control unit 40 based on the recognition of the reference signal, each of the image forming units 1Y, 1M, 1C, and 1K is configured to start image formation.

Further, on the downstream side of the black image forming unit 1K, an image density sensor 43 that adjusts an image quality is arranged.

Further, the image forming apparatus according to the present disclosure includes, as a transporting unit that transports the paper K, a paper accommodating unit 50 that accommodates the paper K; a paper feed roll 51 that takes out and transports the paper K accumulated in the paper accommodating unit 50 at a predetermined timing; a transport roll 52 that transports the paper K fed by the paper feed roll 51; a transport guide 53 that feeds the paper K transported by the transport roll 52 to the secondary transfer unit 20; a transport belt 55 that transports the paper K transported after being secondarily transferred by the secondary transfer roll 22, to the fixing device 60; and a fixing inlet guide 56 that guides the paper K to the fixing device 60.

Next, a basic image forming process of the image forming apparatus according to the present disclosure will be described.

In the image forming apparatus according to the present disclosure, image data output from an image reading device (not shown), a personal computer (PC) (not shown), or the like is subjected to image processing by an image processing device (not shown), and then the image forming units 1Y, 1M, 1C, and 1K execute an image forming work.

The image processing device performs image processing such as various image editing such as shading correction, position shift correction, brightness/color space conversion, gamma correction, frame erasing or color editing, and movement editing on the input reflectance data. The image data subjected to the image processing is converted into color material gradation data of four colors of Y, M, C, and K, and is output to the laser exposure machine 13.

In the laser exposure machine 13, for example, the exposure beam Bm emitted from the semiconductor laser is applied to the photoconductors 11 of the image forming units 1Y, 1M, 1C, and 1K according to the input color material gradation data. In each of the photoconductors 11 of the image forming units 1Y, 1M, 1C, and 1K, after the surface is charged by the charger 12, the surface is scanned and exposed by the laser exposure machine 13, and an electrostatic latent image is formed. The formed electrostatic latent image is developed as a toner image of each color of Y, M, C, and K by the each of the image forming units 1Y, 1M, 1C, and 1K.

The toner image formed on the photoconductors 11 of the image forming units 1Y, 1M, 1C, and 1K is transferred onto the intermediate transfer belt 15 in the primary transfer unit 10 in which each photoconductor 11 and the intermediate transfer belt 15 come into contact with each other. More specifically, in the primary transfer unit 10, the primary transfer roll 16 applies a voltage (primary transfer bias) opposite to the charging polarity (minus polarity) of the toner to the base material of the intermediate transfer belt 15, and the toner image is sequentially superposed on the surface of the intermediate transfer belt 15 to perform the primary transfer.

After the toner image is sequentially primary-transferred to the surface of the intermediate transfer belt 15, the intermediate transfer belt 15 moves and the toner image is transported to the secondary transfer unit 20. In a case where the toner image is transported to the secondary transfer unit 20, in the transporting unit, the paper feed roll 51 rotates in accordance with the timing at which the toner image is transported to the secondary transfer unit 20, and the paper K having a target size is supplied from the paper accommodating unit 50. The paper K supplied by the paper feed roll 51 is transported by the transport roll and reaches the secondary transfer unit 20 via the transport guide 53. Before reaching the secondary transfer unit 20, the paper K is temporarily stopped, and the alignment roll (not shown) rotates according to the movement timing of the intermediate transfer belt 15 on which the toner image is held. Therefore, the position of the paper K and the position of the toner image are aligned.

In the secondary transfer unit 20, the secondary transfer roll 22 is pressed against the back surface roll 25 via the intermediate transfer belt 15. In this case, the paper K transported at the same timing is sandwiched between the intermediate transfer belt 15 and the secondary transfer roll 22. At that time, in a case where a voltage (secondary transfer bias) having the same polarity as the charging polarity (minus polarity) of the toner is applied from the power feeding roll 26, a transfer electric field is formed between the secondary transfer roll 22 and the back surface roll 25. The unfixed toner image held on the intermediate transfer belt 15 is electrostatically transferred onto the paper K collectively in the secondary transfer unit 20 pressed by the secondary transfer roll 22 and the back surface roll 25.

Thereafter, the paper K on which the toner image is electrostatically transferred is transported as-is in a state of being peeled off from the intermediate transfer belt 15 by the secondary transfer roll 22, and is transported to the transport belt 55 provided on the downstream side of the secondary transfer roll 22 in the paper transport direction. The transport belt 55 transports the paper K to the fixing device 60 according to the optimum transport speed in the fixing device 60. The unfixed toner image on the paper K transported to the fixing device 60 is fixed on the paper K by being subjected to a fixing process by heat and pressure by the fixing device 60. The paper K on which the fixed image is formed is transported to an ejected paper accommodating portion (not shown) provided in the ejection unit of the image forming apparatus.

On the other hand, after the transfer to the paper K is completed, the residual toner remaining on the intermediate transfer belt 15 is transported to the cleaning unit as the intermediate transfer belt 15 rotates, and is removed from the intermediate transfer belt 15 by the cleaning back surface roll 34 and the intermediate transfer belt cleaner 35.

Although the present exemplary embodiment has been described above, the present disclosure is not limited to the above exemplary embodiments, and various modifications, changes, and improvements may be made.

EXAMPLES

Hereinafter, the present disclosure will be described in more detail with reference to examples. However, the present disclosure is not limited to the following examples.

Example 1

Formation of Resin Base Material Layer

A base material layer-forming coating liquid containing a polyamic acid (solid content concentration: 18% by mass) is applied onto a cylindrical mold, and the obtained coating film is fired at 380° C. to form a cylindrical resin base material layer (film thickness: 80 μm).

Formation of Elastic Layer

A butyl acetate and carbon nanotubes (manufactured by Showa Denko KK) are mixed at a mass ratio of 15:85 to prepare a dispersion liquid (hereinafter, also referred to as "CNT 15% dispersion"). The obtained dispersion liquid is subjected to a high-pressure dispersion treatment with a high-pressure homogenizer (HC3 manufactured by Sanmaru Kikai Kogyo Co., Ltd.) (Conditions: liquid temperature 45° C., 50 MPa, 3 cycles (that is, the number of times of passing through the valve (number of passes) 3 times)).

Subsequently, 50 parts by mass of a silicone rubber stock solution (X-34-1053 manufactured by Shin-Etsu Chemical Co., Ltd., solid content concentration: 60% by mass, solvent: butyl acetate) is added to 50 parts by mass of the dispersion liquid after the high-pressure dispersion treatment to prepare a precursor liquid. The obtained precursor liquid is agitated with a planetary mixer (ACM-5LVT manufactured by Aikosha Seisakusho Co., Ltd.) for 10 minutes under a condition of liquid temperature of 30° C. with vacuuming.

As described above, an elastic layer-forming coating liquid containing 20% by mass of an aggregate (that is, a specific aggregate) in which plural carbon nanotubes are entangled with each other in the solid content is obtained.

Next, the obtained elastic layer-forming coating liquid is applied onto the base material layer to form a coating film, and the coating film is heated at 100° C. for 30 minutes to form an elastic layer having a film thickness of 450 μm.

Formation of Release Layer

A PFA tube (manufactured by Gunze Co., Ltd.) having a film thickness of 35 μm is placed on an elastic layer and heated at 200° C. for 120 minutes to form a release layer consisting of a fluororesin tube.

Through the above steps, a fixing belt is obtained.

Examples 2 and 3

A fixing belt is produced in the same manner as in Example 1 except that the method for forming the elastic layer is changed to the following method.

That is, an elastic layer is formed in the same manner as in Example 1 except that in the formation of the elastic layer of Example 1, the high-pressure dispersion treatment is performed in two cycles, and further the agitating time of the precursor liquid by the planetary mixer is changed to 45 minutes (Example 2) or 60 minutes (Example 3).

Examples 4 to 8

A fixing belt is produced in the same manner as in Example 1 except that the method for forming the elastic layer is changed to the following method.

That is, the elastic layer is formed in the same manner as in Example 1 except that, in the formation of the elastic layer of Example 1, the amount of the dispersion liquid after the high-pressure dispersion treatment and the amount of the silicone rubber stock solution are changed as follows.

Example 4

0.4 parts by mass of the dispersion liquid after the high-pressure dispersion treatment and 99.6 parts by mass of the silicone rubber stock solution

Example 5

14.75 parts by mass of the dispersion liquid after the high-pressure dispersion treatment and 70 parts by mass of the silicone rubber stock solution

Example 6

74.3 parts by mass of the dispersion liquid after the high-pressure dispersion treatment and 34.5 parts by mass of the silicone rubber stock solution

Example 7

80 parts by mass of the dispersion liquid after the high-pressure dispersion treatment and 30 parts by mass of the silicone rubber stock solution

Example 8

50 parts by mass of the dispersion liquid after the high-pressure dispersion treatment and 15.28 parts by mass of the silicone rubber stock solution

Examples 9 to 12

A fixing belt is produced in the same manner as in Example 1 except that the method for forming the elastic layer is changed to the following method.

That is, the elastic layer is formed in the same manner as in Example 1 except that, in the formation of the elastic layer of Example 1, an elastic layer-forming coating liquid obtained by preparing a precursor liquid in which the amount of the dispersion liquid after the high-pressure dispersion treatment and the amount of the silicone rubber stock solution are changed as follows, agitating the precursor liquid with a planetary mixer, thereafter, adding a CNT 15% dispersion liquid used in Example 1 in the amount as follows, and further agitating the mixture with the planetary mixer under the conditions of temperature 30° C., at a normal pressure, for 1 minute is used.

Example 9

33.15 parts by mass of the dispersion liquid after the high-pressure dispersion treatment, 65 parts by mass of the silicone rubber stock solution, and 1.48 parts by mass of CNT 15% dispersion liquid Example 10

28.25 parts by mass of the dispersion liquid after the high-pressure dispersion treatment, 100 parts by mass of the silicone rubber stock solution, and 42.35 parts by mass of CNT 15% dispersion liquid Example 11

21.2 parts by mass of the dispersion liquid after the high-pressure dispersion treatment, 60.1 parts by mass of the silicone rubber stock solution, and 21.2 parts by mass of CNT 15% dispersion liquid Example 12

43.6 parts by mass of the dispersion liquid after the high-pressure dispersion treatment, 65 parts by mass of the silicone rubber stock solution, and 2.3 parts by mass of CNT 15% dispersion liquid Comparative Example 1

A fixing belt is produced in the same manner as in Example 1 except that the method for forming the elastic layer is changed to the following method.

That is, 50 parts by mass of a silicone rubber stock solution (X-34-1053 manufactured by Shin-Etsu Chemical Co., Ltd., solid content concentration: 60% by mass, solvent: butyl acetate) is mixed with 50 parts by mass of the dispersion liquid (CNT 15% dispersion liquid) which is not subjected to the high-pressure dispersion treatment used in the formation of the elastic layer of Example 1 to prepare a precursor liquid, and an elastic layer-forming coating liquid is obtained setting an agitating time of the obtained precursor liquid by a planetary mixer to 1 minute. An elastic layer is formed in the same manner as in Example 1 except that the elastic layer-forming coating liquid is used.

Comparative Example 2

A fixing belt is produced in the same manner as in Example 1 except that the method for forming the elastic layer is changed to the following method.

An elastic layer is formed in the same manner as in Example 1 except that the silicone rubber stock solution (X-34-1053 manufactured by Shin-Etsu Chemical Co., Ltd., solid content concentration: 60% by mass, solvent: butyl acetate) is used as-is as the elastic layer-forming coating liquid.

Comparative Example 3

A fixing belt is produced in the same manner as in Example 1 except that the method for forming the elastic layer is changed to the following method.

That is, in the formation of the elastic layer of Example 1, the precursor liquid obtained by using the dispersion liquid in which the high-pressure dispersion treatment is performed in two cycles is agitated in a planetary mixer (ACM-5LVT manufactured by Aikosha Seisakusho Co., Ltd.) under the conditions of a liquid temperature of 30° C. for 80 minutes with vacuuming.

As described above, an elastic layer-forming coating liquid containing 20% by mass of an aggregate (that is, a specific aggregate) in which plural carbon nanotubes are entangled with each other is obtained.

Next, the obtained elastic layer-forming coating liquid is applied onto the base material layer to form a coating film, and the coating film is heated at 100° C. for 30 minutes to form an elastic layer having a film thickness of 450 μm.

Measurement of Thermal Conductivity

The thermal conductivity of the elastic layer obtained in each example is measured according to the method described above.

Measurement of Young's Modulus

The Young's modulus of the elastic layer obtained in each example is measured according to the method described above.

Evaluation of Offset

The fixing belt obtained in each example is attached to a fixing device of an image forming apparatus (manufactured by Fuji Xerox Co., Ltd.: Versant 3100 Press).

300,000 solid images with an image density of 100% are output on A4 paper with 100% Cin, by using the image forming apparatus. As a condition during fixing, the output speed (printing speed) is set to 60 sheets per minute (denoted as "60 ppm" in table) or 120 sheets (denoted as "120 ppm"). Further, for the A4 paper, three kinds of plain paper (P paper manufactured by Fuji Xerox Business Innovation Co., Ltd.), thick paper (JD coat 157 manufactured by Fuji Xerox Business Innovation Co., Ltd.), and embossed paper with large surface unevenness (REZAC 66 manufactured by Tokai Paper Co., Ltd.) are used.

After the printing, the fixing belt is removed, and the surface of the removed fixing belt is visually observed to evaluate the offset.

The offset is evaluated according to the following criteria.

A: No offset is seen on the fixing belt.

B: A slight offset (1 or more and 3 or less points) on the fixing belt is seen.

C: An offset is seen in a part of the fixing belt (4 or more and 7 or less points).

D: A large number of offsets (8 or more points) are seen on the fixing belt.

TABLE 1

| | Film | Specific aggregate | | | Content B of fibrous carbons | | | Thermal | Offset | | | | | |
|---|---|---|---|---|---|---|---|---|---|---|---|---|---|---|
| | | | | | | | | | Plain paper | | Thick paper | | Embossed paper | |
| | thickness of base material layer [μm] | Maximum diameter [μm] | Content A (% by mass) | Minor axis Y/Major axis X | which are not entangled each other [% by mass] | A/(A + B) | Young's modulus [MPa] | conductivity [S/m · K] | 60 ppm | 120 ppm | 60 ppm | 120 ppm | 60 ppm | 120 ppm |
| Example 1 | 450 | 10 | 20 | 0.5 | 0 | — | 0.53 | 2.77 | A | A | A | A | A | A |
| Example 2 | 450 | 30 | 20 | 0.2 | 0 | — | 0.55 | 2.49 | A | A | A | A | A | A |
| Example 3 | 450 | 60 | 20 | 0.1 | 0 | — | 0.54 | 2.31 | A | A | A | A | A | A |
| Example 4 | 450 | 10 | 0.1 | 0.5 | 0 | — | 0.21 | 1.02 | A | A | A | A | A | A |
| Example 5 | 450 | 10 | 5 | 0.5 | 0 | — | 0.25 | 1.81 | A | A | A | A | A | A |
| Example 6 | 450 | 10 | 35 | 0.5 | 0 | — | 0.87 | 3.39 | A | A | A | A | A | A |
| Example 7 | 450 | 10 | 40 | 0.5 | 0 | — | 0.98 | 4.47 | A | A | A | A | A | A |
| Example 8 | 450 | 10 | 45 | 0.5 | 0 | — | 1.33 | 4.72 | A | A | A | A | B | C |
| Example 9 | 450 | 10 | 11.25 | 0.5 | 3.75 | 0.75 | 0.37 | 2.80 | A | A | A | A | A | A |
| Example 10 | 450 | 10 | 6 | 0.5 | 9 | 0.4 | 0.44 | 2.26 | A | A | A | A | A | A |
| Example 11 | 450 | 10 | 7.5 | 0.5 | 7.5 | 0.5 | 0.39 | 3.65 | A | A | A | A | A | A |
| Example 12 | 450 | 10 | 14.25 | 0.5 | 0.75 | 0.95 | 0.33 | 3.89 | A | A | A | A | A | A |
| Comparative Example 1 | 450 | — | 0 | — | 20 | — | 0.62 | 0.93 | A | C | C | D | C | D |
| Comparative Example 2 | 450 | — | 0 | — | 0 | — | 0.19 | 0.67 | B | D | C | D | C | D |
| Comparative Example 3 | 450 | 68 | 20 | 0.08 | 0 | — | 1.02 | 2.98 | A | A | A | A | C | D |

From the above results, it can be seen that the fixing belt of the present examples suppresses the offset even in a case of using a recording medium having a large surface unevenness such as embossed paper as compared with the fixing belt of the comparative example.

It can also be seen that the fixing belt of the present examples suppresses offset regardless of whether the paper is plain paper or thick paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing belt comprising, in the following order:

a resin base material layer;

an elastic layer; and a release layer, wherein the elastic layer contains an elastic material and an aggregate in which a plurality of fibrous carbons are entangled with each other, and a maximum diameter of the aggregate is 2% or more and 15% or less of a film thickness of the elastic layer.

2. The fixing belt according to claim 1, wherein the elastic layer further contains fibrous carbons that are not entangled with each other.

3. The fixing belt according to claim 2, wherein a content A of the aggregate and a content B of the fibrous carbons that are not entangled with each other satisfy a relationship of A≥B on a mass basis.

4. The fixing belt according to claim 3, wherein a ratio (A/(A+B)) of a content A of the aggregate to a total amount of the content A of the aggregate and a content B of the fibrous carbons that are not entangled with each other is 0.50 or more and 0.95 or less on a mass basis.

5. The fixing belt according to claim 4, wherein a content of the aggregate is 0.1% by mass or more and 40% by mass or less with respect to a total mass of the elastic layer.

6. The fixing belt according to claim 5, wherein the content of the aggregate is 10% by mass or more and 30% by mass or less with respect to the total mass of the elastic layer.

7. The fixing belt according to claim 2, wherein a ratio (A/(A+B)) of a content A of the aggregate to a total amount of the content A of the aggregate and a content B of the fibrous carbons that are not entangled with each other is 0.50 or more and 0.95 or less on a mass basis.

8. The fixing belt according to claim 7, wherein a content of the aggregate is 0.1% by mass or more and 40% by mass or less with respect to a total mass of the elastic layer.

9. The fixing belt according to claim 8, wherein the content of the aggregate is 10% by mass or more and 30% by mass or less with respect to the total mass of the elastic layer.

10. The fixing belt according to claim 2, wherein a content of the aggregate is 0.1% by mass or more and 40% by mass or less with respect to a total mass of the elastic layer.

11. The fixing belt according to claim 10, wherein the content of the aggregate is 10% by mass or more and 30% by mass or less with respect to the total mass of the elastic layer.

12. The fixing belt according to claim 3, wherein a content of the aggregate is 0.1% by mass or more and 40% by mass or less with respect to a total mass of the elastic layer.

13. The fixing belt according to claim 12, wherein the content of the aggregate is 10% by mass or more and 30% by mass or less with respect to the total mass of the elastic layer.

14. The fixing belt according to claim 1, wherein a content of the aggregate is 0.1% by mass or more and 40% by mass or less with respect to a total mass of the elastic layer.

15. The fixing belt according to claim 14, wherein the content of the aggregate is 10% by mass or more and 30% by mass or less with respect to the total mass of the elastic layer.

16. The fixing belt according to claim 1, wherein the elastic layer has a Young's modulus of 0.2 MPa or more and 1.0 MPa or less.

17. The fixing belt according to claim 1, wherein the fibrous carbons are carbon nanotubes.

18. A fixing device comprising:

a first rotating body; and a second rotating body arranged in contact with an outer surface of the first rotating body, wherein at least one of the first rotating body or the second rotating body is the fixing belt according to claim 1, and a toner image is fixed by inserting a recording medium having the toner image formed on a surface into a contact portion between the first rotating body and the second rotating body.

19. An image forming apparatus comprising:

an image holder;

a charging unit that charges a surface of the image holder;

an electrostatic latent image forming unit that forms an electrostatic latent image on the charged surface of the image holder;

a developing unit that develops the electrostatic latent image formed on the surface of the image holder by a developer containing a toner to form a toner image;

a transfer unit that transfers the toner image to a surface of a recording medium; and a fixing unit that fixes the toner image to the recording medium and is configured of the fixing device according to claim 18.

* * * * *